US011189960B2

(12) United States Patent
Hsu et al.

(10) Patent No.: US 11,189,960 B2
(45) Date of Patent: Nov. 30, 2021

(54) ELECTRICAL CONNECTOR WITH SEALING FEATURE

(71) Applicant: SPEED TECH CORP., Taoyuan (TW)

(72) Inventors: Chien-Yu Hsu, Taoyuan (TW); Hui-Hsueh Chiang, Taoyuan (TW); Hua-Chun Chang, Taoyuan (TW)

(73) Assignee: SPEED TECH CORP., Taoyuan (TW)

( * ) Notice: Subject to any disclaimer, the term of this patent is extended or adjusted under 35 U.S.C. 154(b) by 0 days.

(21) Appl. No.: 16/919,578

(22) Filed: Jul. 2, 2020

(65) Prior Publication Data

US 2021/0006006 A1 Jan. 7, 2021

(30) Foreign Application Priority Data

Jul. 3, 2019 (TW) ..... 108123473

(51) Int. Cl.

| | |
|---|---|
| ***H01R 13/52*** | (2006.01) |
| ***H01R 13/6581*** | (2011.01) |
| *H01R 107/00* | (2006.01) |
| *H01R 13/533* | (2006.01) |
| *H01R 13/40* | (2006.01) |
| *H01R 24/60* | (2011.01) |

(Continued)

(52) U.S. Cl.

CPC ..... *H01R 13/521* (2013.01); *H01R 13/5202* (2013.01); *H01R 13/5219* (2013.01); *H01R 13/6581* (2013.01); *H01R 13/40* (2013.01); *H01R 13/52* (2013.01); *H01R 13/523* (2013.01); *H01R 13/533* (2013.01); *H01R 13/648* (2013.01); *H01R 24/60* (2013.01); *H01R 2107/00* (2013.01); *H01R 2201/06* (2013.01)

(58) Field of Classification Search

CPC ..... H01R 13/521; H01R 13/5202; H01R 13/6581; H01R 13/5219; H01R 2107/00; H01R 2201/06; H01R 24/60; H01R 13/648; H01R 13/40; H01R 13/523; H01R 13/533; H01R 13/52

See application file for complete search history.

(56) References Cited

U.S. PATENT DOCUMENTS 10,249,981 B2 * 4/2019 Chen ..... H01R 13/5219

FOREIGN PATENT DOCUMENTS

| | | | | |
|---|---|---|---|---|
| EP | 3382815 A2 * | 10/2018 | ..... | H01R 13/6594 |
| TW | M548907 U * | 9/2017 | ..... | H01R 13/52 |
| TW | M548907 U | 9/2017 | | |

(Continued)

*Primary Examiner* — Abdullah A Riyami
*Assistant Examiner* — Justin M Kratt
(74) *Attorney, Agent, or Firm* — Birch, Stewart, Kolasch & Birch, LLP

(57) ABSTRACT

An electrical connector includes an outer case, an insulation base, an elastic airtight member and a conductive terminal. The outer case includes a main frame, and a partition member formed within the main frame to define a first slot and a second slot therein. The insulation base is fixedly connected to the main frame, and disposed within the second slot. The elastic airtight member is disposed within the second slot, and interposed between the insulation base and the partition member. The conductive terminal is disposed within the insulation base, the elastic airtight member and the partition member, and extends into the first slot from the partition member, and extending outwards the insulation base from the second slot.

20 Claims, 10 Drawing Sheets

(51) Int. Cl.
*H01R 13/523* (2006.01)
*H01R 13/648* (2006.01)

(56) References Cited

FOREIGN PATENT DOCUMENTS

| | | | |
|---|---|---|---|
| TW | M552694 | U | 12/2017 |
| TW | I635667 | B | 9/2018 |

* cited by examiner

ELECTRICAL CONNECTOR WITH SEALING FEATURE

RELATED APPLICATIONS

This application claims priority to Taiwan Application Serial Number 108123473, filed Jul. 3, 2019, which is herein incorporated by reference.

BACKGROUND

Field of Disclosure

The disclosure relates to an electrical connector. More particularly, the disclosure relates to an electrical connector with a waterproof assembly.

Description of Related Art

In present, if an electrical connector lacks waterproof assembly designs, a back-end device (e.g., a circuit board) of the electrical connector may inevitably be exposed to the atmosphere to be damp easily due to contacting with moisture, thereby damaging the back-end device to be inoperable, and resulting extremely inconvenient in use. Thus, in order to prevent rain or moisture from infiltrating into the back-end device via the electrical connector, most of electrical connectors respectively adopt a complicated waterproof design to reduce the chance of moisture entering the back-end device.

However, only using the conventional waterproof design cannot meet the requirements of manufacturers for structural simplification and cost improvement. Therefore, the present industry maker not only needs solutions that can simplify the structure and improve the cost, but also needs the waterproof design having at least maintain the original waterproof performance.

SUMMARY

In one aspect of the disclosure, an electrical connector is provided for solving the problems mentioned in the prior art.

In one embodiment of the disclosure, an electrical connector is provided, and includes an outer case, an insulation base, an elastic airtight member and at least one conductive terminal. The outer case includes a main frame, and a partition member formed within the main frame to define a first slot and a second slot therein. The first slot is used to receive an outer connector. The insulation base is fixedly connected to the main frame, and disposed within the second slot. The insulation base is formed with at least one accommodating passage. The elastic airtight member is disposed within the second slot, and interposed between the insulation base and the partition member. The elastic airtight member hermetically covers the partition member directly, and the elastic airtight member is formed with at least one first through hole. The conductive terminal is disposed within the insulation base, the elastic airtight member and the partition member. One end of the conductive terminal extends into the first slot from the partition member, and the other end of the conductive terminal extends outwards from the insulation base through the second slot. The conductive terminal directly goes through the first through hole and the accommodating passage.

According to one or more embodiments of the disclosure, in the electrical connector, the second slot of the main frame is formed with a plurality of inner side walls, and the inner side walls are collectively adjoined to surround the partition member, wherein the elastic airtight member is in contact with the inner side walls, the partition member and the insulation base, respectively.

According to one or more embodiments of the disclosure, in the electrical connector, the elastic airtight member includes an elastic body and at least one strip-shaped convex portion. The elastic body is sandwiched between the insulation base and the partition member. The strip-shaped convex portion is protrudingly formed on an outer side surface of the elastic body, and the strip-shaped convex portion surrounds the elastic body to be pressed by the inner side walls of the second slot.

According to one or more embodiments of the disclosure, in the electrical connector, the strip-shaped convex portion is plural in number, and a concave portion is formed between any two neighboring ones of the strip-shaped convex portion.

According to one or more embodiments of the disclosure, in the electrical connector, the elastic airtight member includes an elastic body and at least one strip-shaped groove. The elastic body is sandwiched between the insulation base and the partition member to be pressed by the inner side walls of the second slot. The strip-shaped groove is concavely formed on outer surfaces of the elastic body to surround the elastic body.

According to one or more embodiments of the disclosure, in the electrical connector, the partition member includes a partitioning plate and at least one second through hole. The partitioning plate is located within the main frame, and directly connected to the inner side walls of the second slot to separate the first slot and second slot, and integrally connected to the main frame. One surface of the partitioning plate is hermetically covered by the elastic airtight member. The second through hole is formed on the partitioning plate to be in communication with the first slot and the second slot. The second through hole is passed through by the conductive terminal.

According to one or more embodiments of the disclosure, in the electrical connector, the partition member includes a partitioning plate and a single break. The partitioning plate is located within the main frame, and directly connected to the inner side walls of the second slot to separate the first slot and second slot, and integrally connected to the main frame. The single break is formed on the partitioning plate to be in communication with the first slot and the second slot. The conductive terminal is arranged within the single break, and a part of the elastic airtight member is in contact with the single break.

According to one or more embodiments of the disclosure, the electrical connector further includes a shielding frame. The shielding frame is disposed within the outer case to collectively surround the elastic airtight member and the conductive terminal for electrically shielding the conductive terminal.

According to one or more embodiments of the disclosure, in the electrical connector, the outer case further includes an external sealing strip. The external sealing strip is disposed on an outer surface of the outer case and totally surrounds the outer case.

According to one or more embodiments of the disclosure, in the electrical connector, a cross-sectional area of the conductive terminal is equal to an aperture size of the first through hole.

In one embodiment of the disclosure, an electrical connector is provided, and includes an outer case and a connector module. The outer case includes a main frame and a partition member, and the partition member is located within the main frame, and provided with at least one penetrating opening. The connector module includes a wired board, an insulation base, at least one conductive terminal and an elastic airtight member. The wired board is connected to the main frame. The insulation base is disposed on one end of the main frame, and a separating space is maintained between the insulation base and the partition member. The insulation base is formed with at least one accommodating passage. The conductive terminal is disposed within the insulation base. One end of the conductive terminal extends through the penetrating opening, and the other end of the conductive terminal is connected to the wired board. The elastic airtight member is disposed in the separating space to hermetically cover the partition member directly and formed with at least one first through hole. The conductive terminal directly goes through the first through hole and the accommodating passage.

According to one or more embodiments of the disclosure, in the electrical connector, the main frame is formed with a plurality of inner side walls, and the inner side walls are collectively adjoined and surround the partition member. The elastic airtight member is in contact with the inner side walls, the partition member and the insulation base, respectively.

According to one or more embodiments of the disclosure, in the electrical connector, the elastic airtight member includes an elastic body and at least one strip-shaped convex portion. The elastic body is sandwiched between the insulation base and the partition member. The strip-shaped convex portion is protrudingly formed on an outer side surface of the elastic body, and the strip-shaped convex portion surrounds the elastic body to be pressed by the partitioning plate.

According to one or more embodiments of the disclosure, in the electrical connector, the partition member includes a partitioning plate and at least one second through hole. The partitioning plate is located within the main frame, and integrally connected to the inner side walls of the main frame. One surface of the partitioning plate is covered by the elastic airtight member. The second through hole is formed on the partitioning plate. The second through hole is passed through by the at least one conductive terminal.

According to one or more embodiments of the disclosure, in the electrical connector, the partition member includes a partitioning plate and a single break. The partitioning plate is located within the main frame, and integrally connected to the inner side walls of the main frame. The single break is formed on the partitioning plate, and the conductive terminal is arranged within the single break, and a part of the elastic airtight member is in contact with the single break.

According to one or more embodiments of the disclosure, the electrical connector further includes a shielding frame. The shielding frame is disposed within the outer case to collectively surround the elastic airtight member and the conductive terminal for electrically shielding the conductive terminal.

With the structure described in the above embodiments, the disclosure can not only effectively prevent moisture from infiltrating into the rear end of the electrical connector, but also meet the purpose of structural simplification and cost improvement of the electrical connector.

The above description is merely used for illustrating the problems to be resolved, the technical methods for resolving the problems and their efficacies, etc. The specific details of the disclosure will be explained in the embodiments below and related drawings.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure. In the drawings.

DESCRIPTION OF THE EMBODIMENTS

Figure 1:
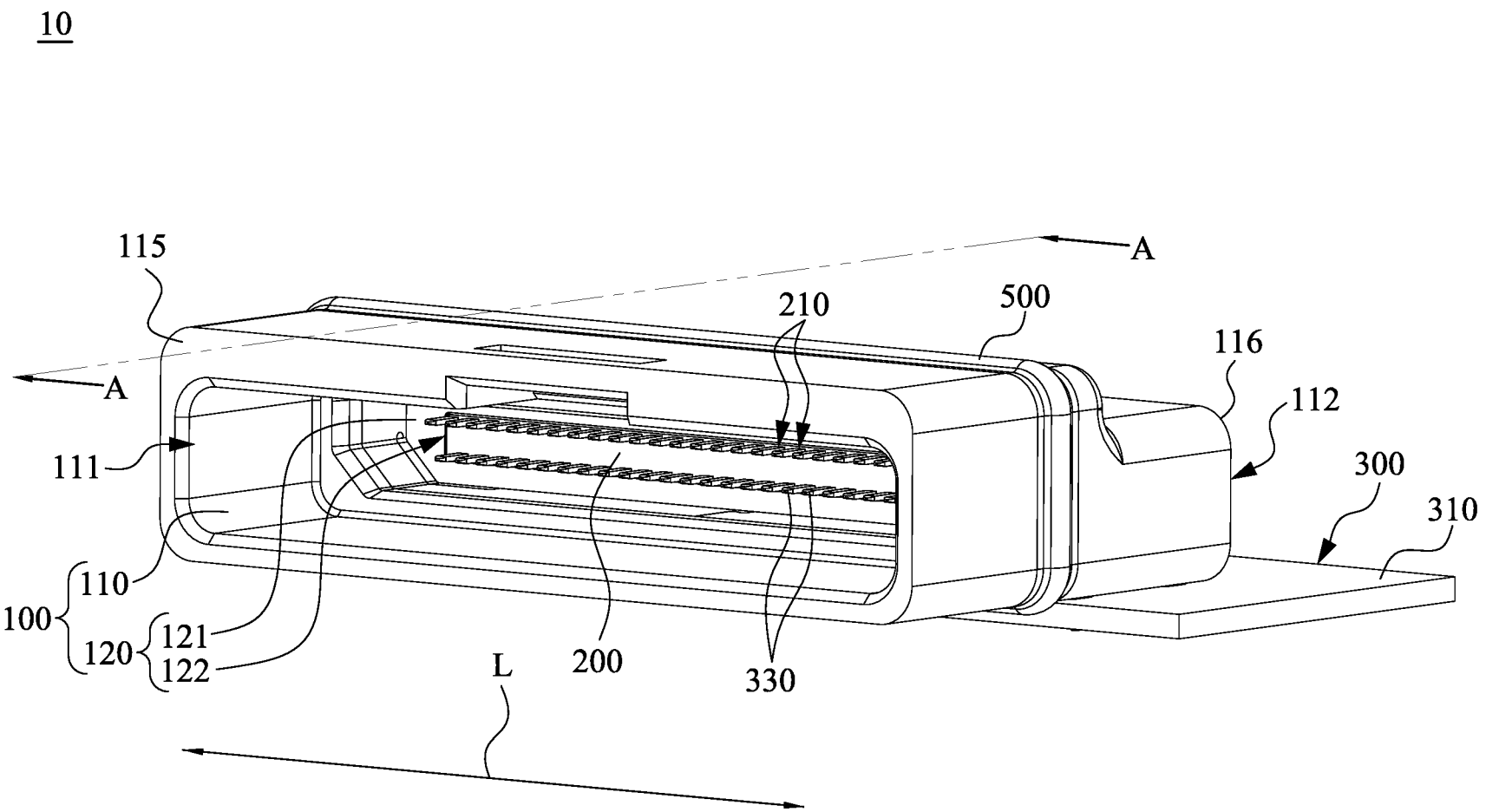
FIG. 1 is a perspective view of an electrical connector according to one embodiment of the disclosure.

Reference will now be made in detail to the present embodiments of the disclosure, examples of which are illustrated in the accompanying drawings. Wherever possible, the same reference numbers are used in the drawings and the description to refer to the same or like parts. According to the embodiments, it will be apparent to those skilled in the art that various modifications and variations can be made to the structure of the disclosure without departing from the scope or spirit of the disclosure.

Figure 2A:
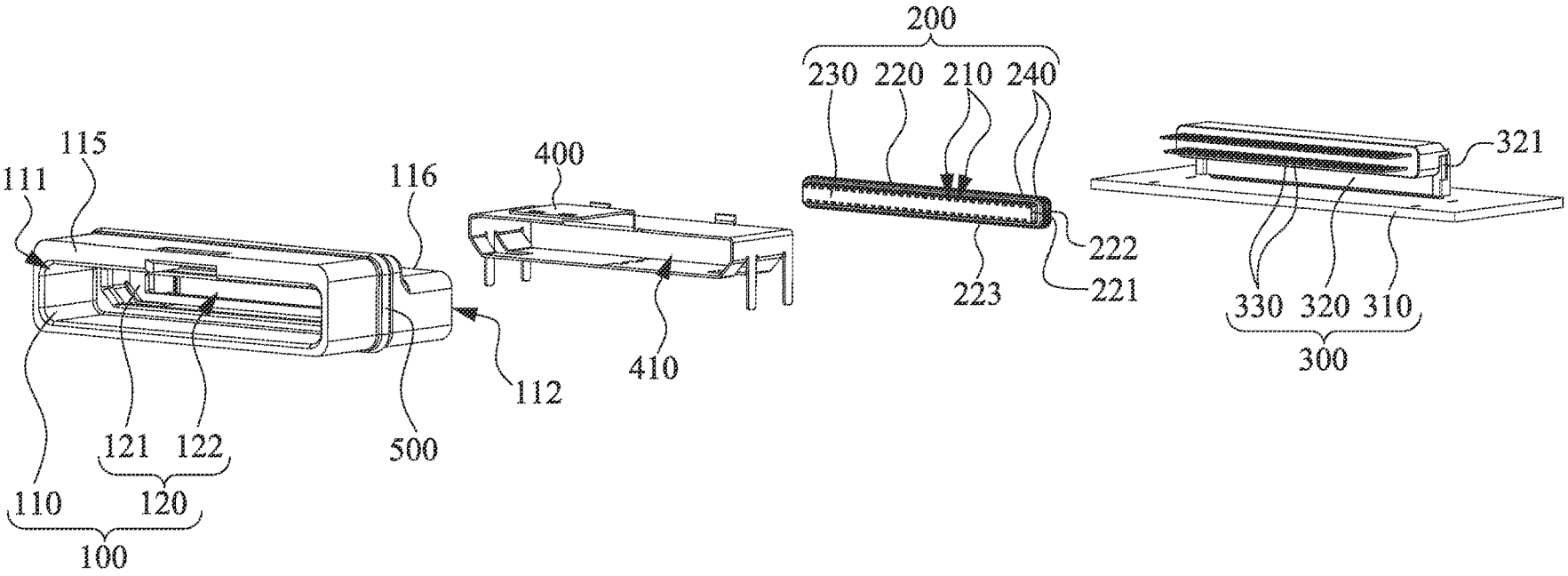
FIG. 2A is an exploded view of the electrical connector of FIG. 1 viewed in one viewing direction.
Figure 2B:
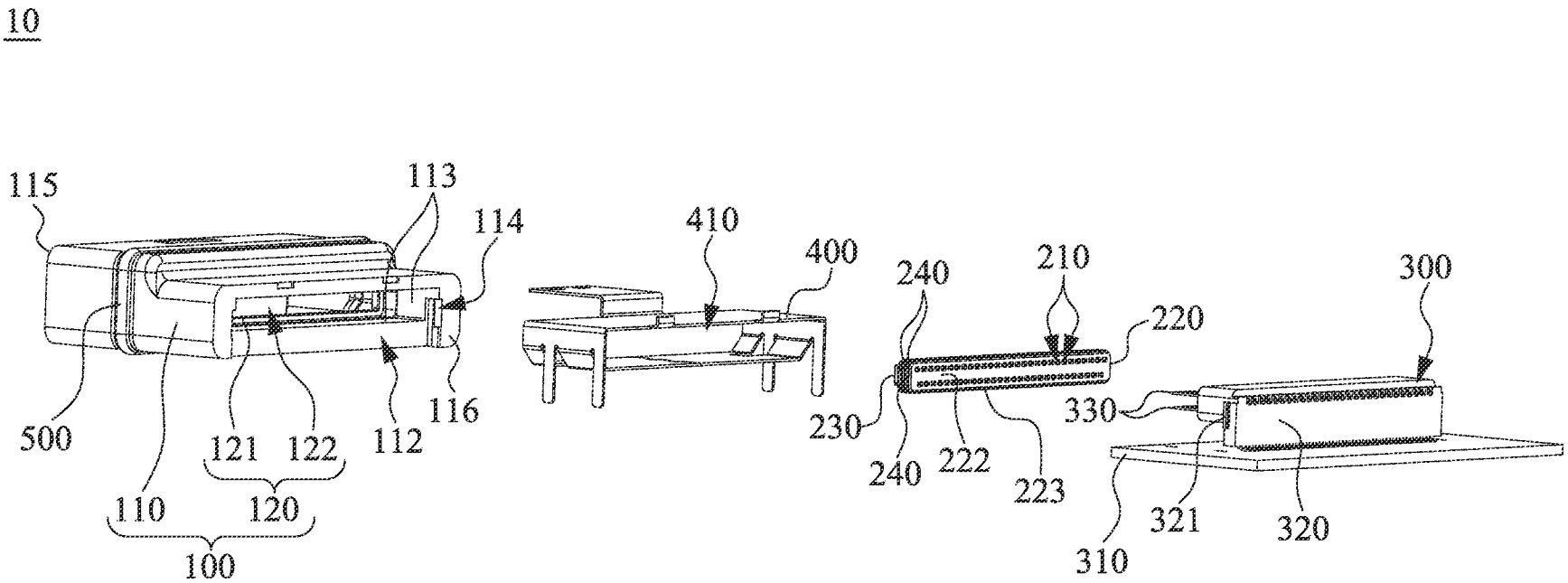
FIG. 2B is an exploded view of the electrical connector of FIG. 1 viewed in another viewing direction.
Figure 3:
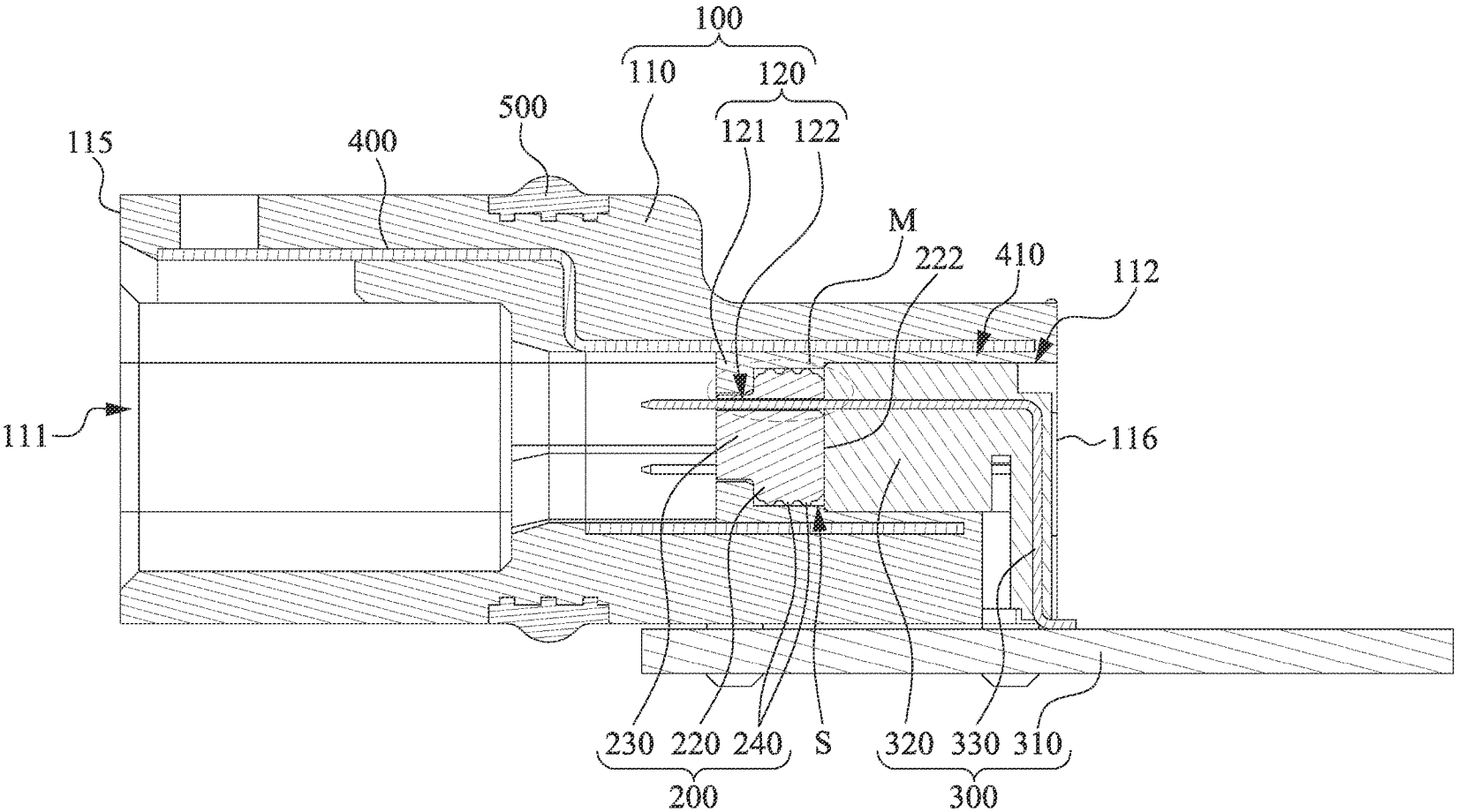
FIG. 3 is a cross-sectional view of the electrical connector of FIG. 1 taken along a line AA.

Reference is now made to FIG. 1 to FIG. 3, in which FIG. 1 is a perspective view of an electrical connector 10 according to one embodiment of the disclosure, FIG. 2A is an exploded view of the electrical connector 10 of FIG. 1 viewed in one viewing direction, FIG. 2B is an exploded view of the electrical connector 10 of FIG. 1 viewed in another viewing direction, and FIG. 3 is a cross-sectional view of the electrical connector 10 of FIG. 1 taken along a line AA. As shown in FIG. 1 to FIG. 3, the electrical connector 10 includes an outer case 100, an elastic airtight member 200 and a connector module 300. The outer case 100 includes a main frame 110 and a partition member 120. The partition member 120 is located within the main frame 110, and is allowed to separate a first slot 111 and a second slot 112 in the main frame 110. In the embodiment, the first slot 111 is formed on one end 115 of the main frame 110, and the first slot 111 is used to receive an outer connector (not shown in figures). The second slot 112 is formed on the other end 116 of the main frame 110 for receiving the connector module 300. In the embodiment, the size of the first slot 111 is larger than the size of the second slot 112 (FIG. 3), however, the disclosure is not limited thereto.

As shown in FIG. 2A and FIG. 3, the connector module 300 includes a wired board 310, an insulation base 320 and a plurality of conductive terminals 330. The main frame 110 is fixedly connected to the wired board 310. The insulation base 320 is located within the second slot 112, and is fixedly connected to the other end 116 of the main frame 110. For example, two opposite sides of the insulation base 320 are respectively provided with two fixing blocks 321 (FIG. 2A), and two inner side walls 113 of the second slot 112 of the main frame 110 are respectively formed with two fixing breaks 114. Therefore, through the mutual engagement of the fixing blocks 321 and the fixing breaks 114, the insulation base 320 is able to be fixed to the other end 116 of the main frame 110, that is, the insulation base 320 is able to be stably received within the second slot 112. However, the disclosure is not limited to the aforementioned engagement fashion.

The elastic airtight member 200 is removably disposed within the second slot 112, and interposed between the partition member 120 and the insulation base 320. The conductive terminals 330 are embedded within the insulation base 320 and the elastic airtight member 200, respectively. More specifically, when the insulation base 320 is formed through an in-mold injection molding process, the conductive terminals 330 are fixedly held in the insulation base 320 together, and the conductive terminals 330 are arranged spaced in the insulation base 320 according to an abreast arrangement. However, the disclosure is not limited thereto, in another embodiment, the conductive terminals may also be assembled in the insulation base after the insulating base is made.

As shown in FIG. 3, each of the conductive terminals 330 goes through the insulation base 320, the elastic airtight member 200 and the partition member 120. The elastic airtight member 200 and the insulation base 320 collectively surround to wrap each of the conductive terminals 330. Specifically, the insulation base 320 is penetrated to form with a plurality of accommodating passages for respectively receiving the conductive terminals 330. One end of each of the conductive terminals 330 extends into the first slot 111 from the partition member 120, and the other end of each of the conductive terminals 330 extends outwards from the insulation base 320 through the second slot 112 to be soldered to the wired board 310. More specifically, the elastic airtight member 200 is formed with a plurality of first through holes 210 which are arranged spaced on the elastic airtight member 200 according to the aforementioned abreast arrangement. The conductive terminals 330 respectively pass through the first through holes 210 and the accommodating passages one by one, that is, each of the conductive terminals 330 within one of the accommodating passages passes through one of the first through holes 210, so that the elastic airtight member 200 is fixed on the conductive terminals 330. More specifically, each of the conductive terminals is, for example, a metal needle, and the cross-sectional area of each conductive terminal 330 is substantially equal to the aperture size of one of the first through holes 210. Therefore, when the connector module 300 enters the second slot 112 to be fixedly assembled to the other end 116 of the main frame 110, the elastic airtight member 200 located at the front end of the connector module 300 is therefore pressed by the insulation base 320 and the partition member 120 respectively, so that the elastic airtight member 200 is compressed and deformed between the insulation base 320 and the partition member 120. On the other words, if a separating space S is maintained between the insulation base 320 and the partition member 120, the elastic airtight member 200 being compressed and deformed is exactly filled within the separating space S totally and located between the conductive terminal 330 within the separating space S, that is, the size of the elastic airtight member 200 being compressed and deformed is substantially same to the size of the separating space S. Also, the aperture size of each first through holes 210 is equal to the cross-sectional area of each conductive terminal 330. Therefore, because the elastic airtight member 200 being compressed and deformed is able to hermetically cover the partition member 120, moisture permeating into the second slot 112 from the partition member 120 can be minified, thereby reducing the possibility that moisture moved to the rear end of the electrical connector 10.

It is noted, in other embodiments, the number of the conductive terminal and the first through hole may be single one only.

Specifically, in the embodiment, as shown in FIG. 3, the second slot 112 of the main frame 110 is provided with inner side walls 113. The inner side walls 113 surround the second slot 112, and collectively adjoin and surround the partition member 120. The outer side surfaces 223 of the elastic airtight member 200 are contacted with the inner side walls 113, the partition member 120 and the insulation base 320, respectively.

Furthermore, in the embodiment, the partition member 120 includes a partitioning plate 121 and a single break 122. The partitioning plate 121 is located within the main frame 110 to be directly connected to the inner side walls 113 of the second slot 112 and surrounded by the inner side walls 113 so as to separate the first slot 111 and the second slot 112 within the main frame 110. The single break 122 can be seen as a penetrating opening which is formed on the partitioning plate 121 and in communication with the first slot 111 and the second slot 112. The elastic airtight member 200 hermetically covers the partitioning plate 121 and the single break 122 so as to further reduce moisture permeating into the second slot 112 from the partition member 120, thereby reducing the possibility that moisture moved to the rear end of the electrical connector 10. In the embodiment, the partitioning plate 121 is integrally connected to the main frame 110, however, the disclosure is not limited thereto.

A part of the elastic airtight member 200 is in contact with the single break 122. For example, the elastic airtight member 200 includes an elastic body 220 and an outer protrusion 230. The elastic body 220 is sandwiched between the insulation base 320 and the partitioning plate 121, and hermetically covers the partitioning plate 121 and the single break 122. The outer protrusion 230 is formed on one side of the elastic body 220 facing away from the insulation base 320, and the outer protrusion 230 matchingly fills in the single break 122 and connected to the first slot 111. In the embodiment, the outer protrusion 230 and the elastic body 220 are integrally formed together, however, the disclosure is not limited thereto.

It is noted, in the embodiment, the volume of the outer protrusion 230 is smaller than the volume of the elastic body 220, the volume of the outer protrusion 230 is approximately the same as the volume of the single break 122, and the long axis direction L of the outer protrusion 230 is parallel to a long axis direction L of the single break 122 and a long axis direction L of the partitioning plate 121, however, the disclosure is not limited thereto.

More specifically, the elastic body 220 is in a flat-plate shape, and the elastic body 220 is provided with a first surface 221, a second surface 222 and one or more outer side surfaces 223 (i.e., peripheral sides). The first surface 221 and the second surface 222 are faced away from each other, and the outer side surfaces 223 collectively adjoin and surround the first surface 221 and the second surface 222. The outer protrusion 230 is disposed on the first surface 221 of the elastic body 220, and the second surface 222 of the elastic body 220 directly presses the insulation base 320. Each of the conductive terminals 330 passes through the elastic body 220 and the outer protrusion 230, and extends outwardly through the first slot 111 so as to achieve electrical connection of the outer connector.

It is noted, in the embodiment, the conductive terminals 330 simultaneously extend outwards from one surface of the outer protrusion 230 facing away from the elastic body 220, which means that the conductive terminals 330 are located in a single break 122, and are not directly contacted with the partition member 120, and not supported by the partition member 120.

As shown in FIG. 2A and FIG. 3, the electrical connector 10 further includes a shielding frame 400. The shielding frame 400 is disposed within the outer case 100. In specific, the shielding frame 400 is embedded inside a solid body of the main frame 110. The shielding frame 400 is formed with a receiving space 410, and the receiving space 410 is able to receive the connector module 300 and the elastic airtight member 200, that is, the shielding frame 400 collectively surrounds the elastic airtight member 200 and the conductive terminals 330 for electrically shielding the conductive terminals 330 from noises.

Also, in the electrical connector 10, the outer case 100 further includes an external sealing strip 500. The external sealing strip 500 is disposed on an outer lateral surface of the outer case 100 and totally surrounds the outer case 100. And further, the external sealing strip 500 is disposed on and totally surrounds an outer lateral surface of the main frame 110. Therefore, with the sealing of the external sealing strip 500, rain or moisture can be prevented from infiltrating into the back-end device via the electrical connector 10 through the external sealing strip 500.

Figure 4:
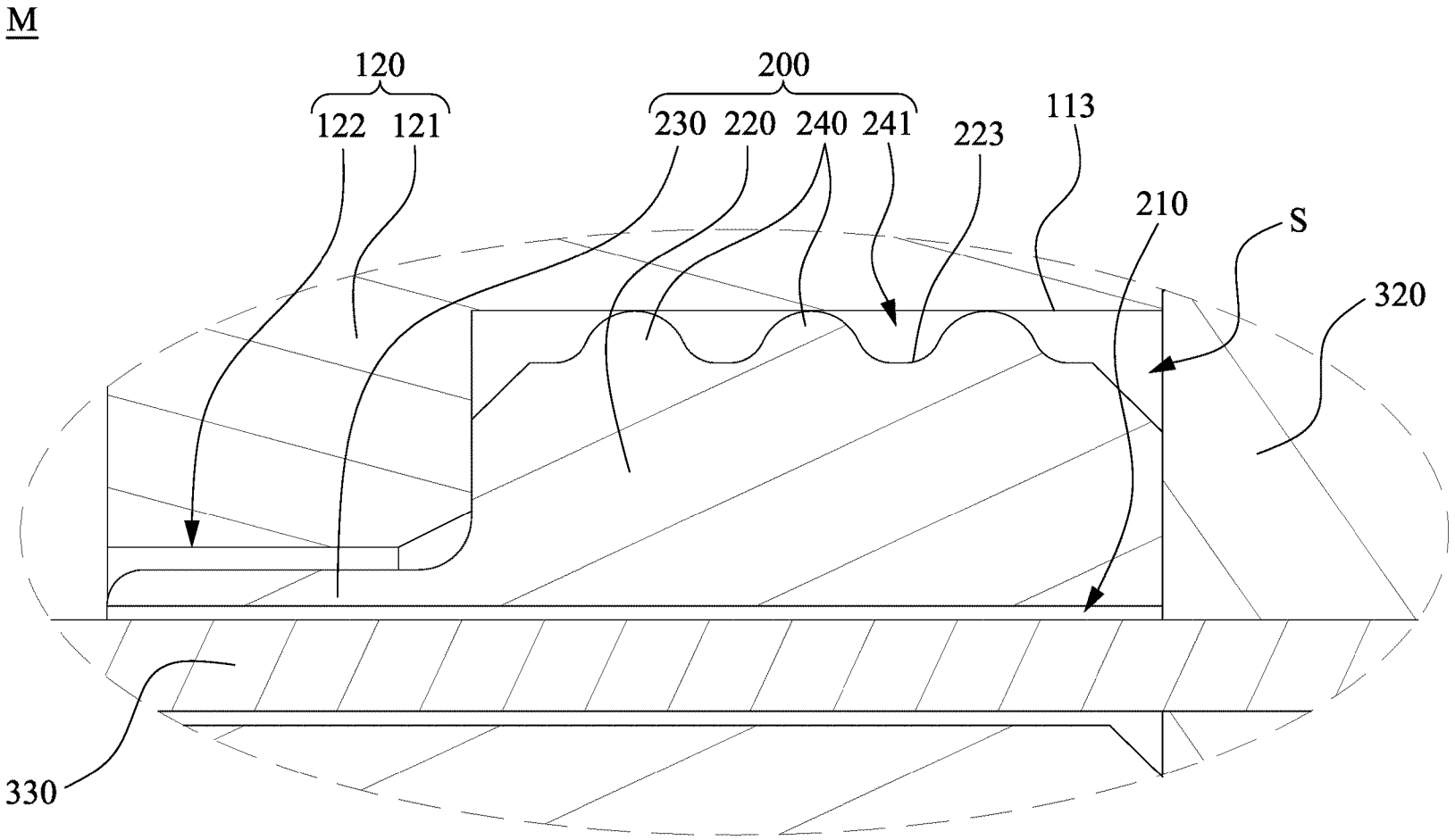
FIG. 4 is a partial enlarged view of a local area M of FIG. 3.

FIG. 4 is a partial enlarged view of a local area M of FIG. 3. As shown in FIG. 2A and FIG. 4, in the embodiment, the elastic airtight member 200 includes a plurality of strip-shaped convex portions 240. The strip-shaped convex portions 240 are protrudingly formed on the outer side surfaces 223 of the elastic airtight member 200. More specifically, the strip-shaped convex portions 240 are arranged spaced on the outer side surfaces 223 abreast, and each of the strip-shaped convex portions 240 surrounds the elastic body 220. For example, each of the strip-shaped convex portions 240 completely surrounds the elastic body 220, which is regarded as an annular body on the elastic body 220. It is noted, in other embodiments, the strip-shaped convex portion may be only one in number.

As shown in FIG. 3 and FIG. 4, in the embodiment, when the elastic airtight member 200 is pushed into the aforementioned separating space S, the strip-shaped convex portions 240 of the elastic airtight member 200 are respectively pressed by the inner side walls 113 of the second slot 112 so that the elastic airtight member 200 can tightly cover the partition member 120, thereby reducing the chance of moisture entering the electronic device. The strip-shaped convex portions 240 of the elastic airtight member 200 are also respectively pressed by the surface of the partitioning plate 121. In addition, a concave portion 241 is formed between any two adjacent strip-shaped convex portions 240. In this way, even if moisture penetrates from the first slot 111 into the second slot 112, the moisture can be stored in the concave portions 241, thereby postponing the moisture flowing to the back-end device via the electrical connector 10.

Figure 5:
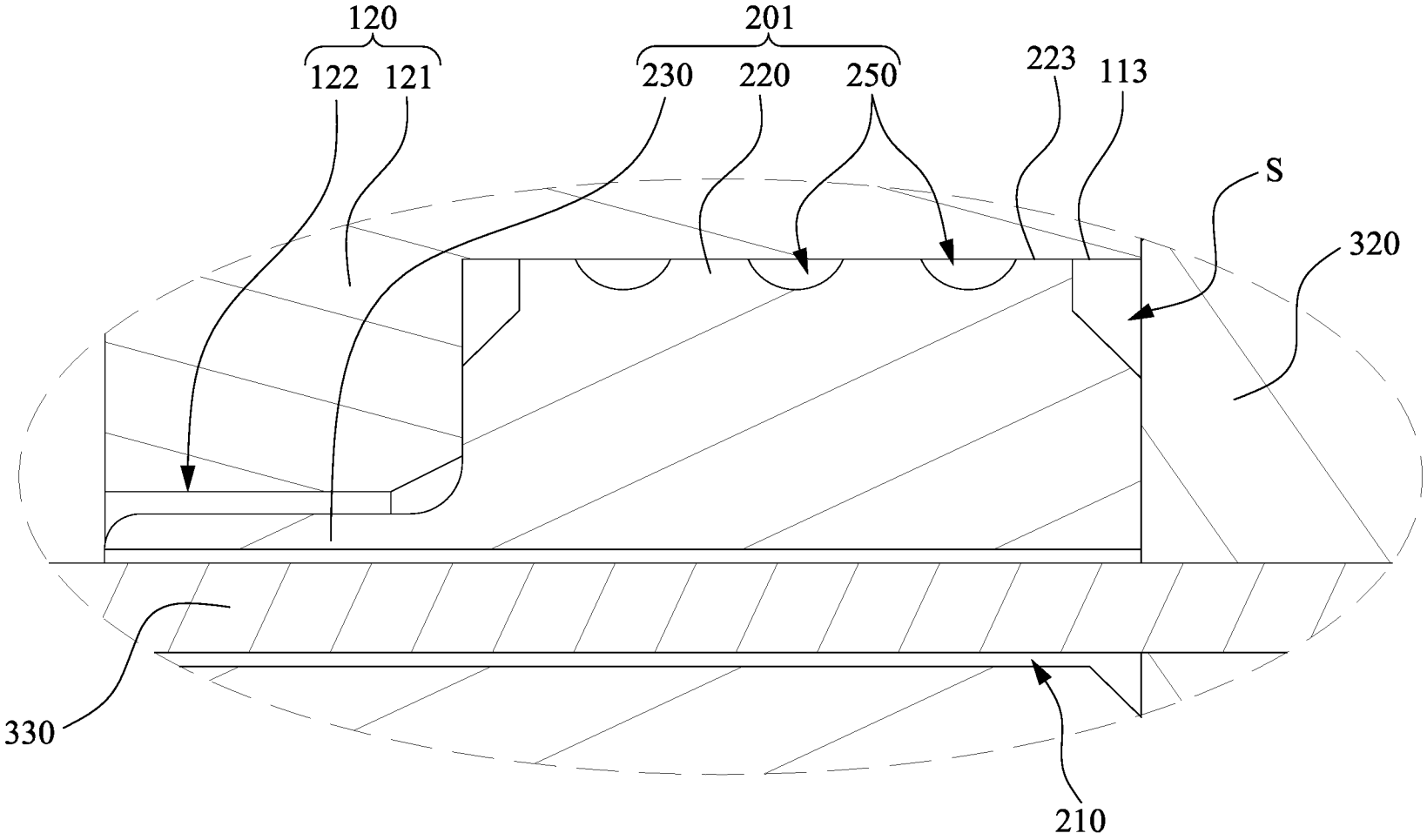
FIG. 5 is a partial schematic view of an elastic airtight member according to one embodiment of the disclosure, whose section position being same as the local area M of FIG. 3.

FIG. 5 is a partial schematic view of an elastic airtight member 201 according to one embodiment of the disclosure, whose section position being same as the local area M of FIG. 3. As shown in FIG. 5, the elastic airtight member 201 of the embodiment is substantially the same to the elastic airtight member 200 of FIG. 2. However, at least one difference of the elastic airtight member 201 of FIG. 5 from the elastic airtight member 200 of FIG. 2 is that, the outer side surfaces 223 of the elastic airtight member 200 in FIG. 5 is formed with a plurality of strip-shaped grooves 250, rather than strip-shaped convex portions. On the other word, each of the strip-shaped grooves 250 is concavely formed on the outer side surfaces 223 of the elastic body 220 to surround the elastic body 220. It is noted, in other embodiments, the strip-shaped groove may be only one in number.

As shown in FIG. 3 and FIG. 5, when the elastic airtight member 201 is pushed into the aforementioned separating space S, the outer side surfaces 223 of the elastic body 220 are respectively pressed by the inner side walls 113 of the second slot 112 so that the elastic airtight member 201 can tightly cover the partition member 120. In this way, even if moisture penetrates from the first slot 111 into the second slot 112, the moisture can be sequentially stored in the strip-shaped grooves 250, thereby postponing the moisture flowing to the back-end device via the electrical connector 10.

It is noted, compared with the concave portion 241 formed between strip-shaped convex portions 240 in FIG. 4, the strip-shaped grooves 250 of this embodiment is able to receive much more moisture, thereby further postponing the moisture flowing to the back-end device via the electrical connector 10.

Figure 6:
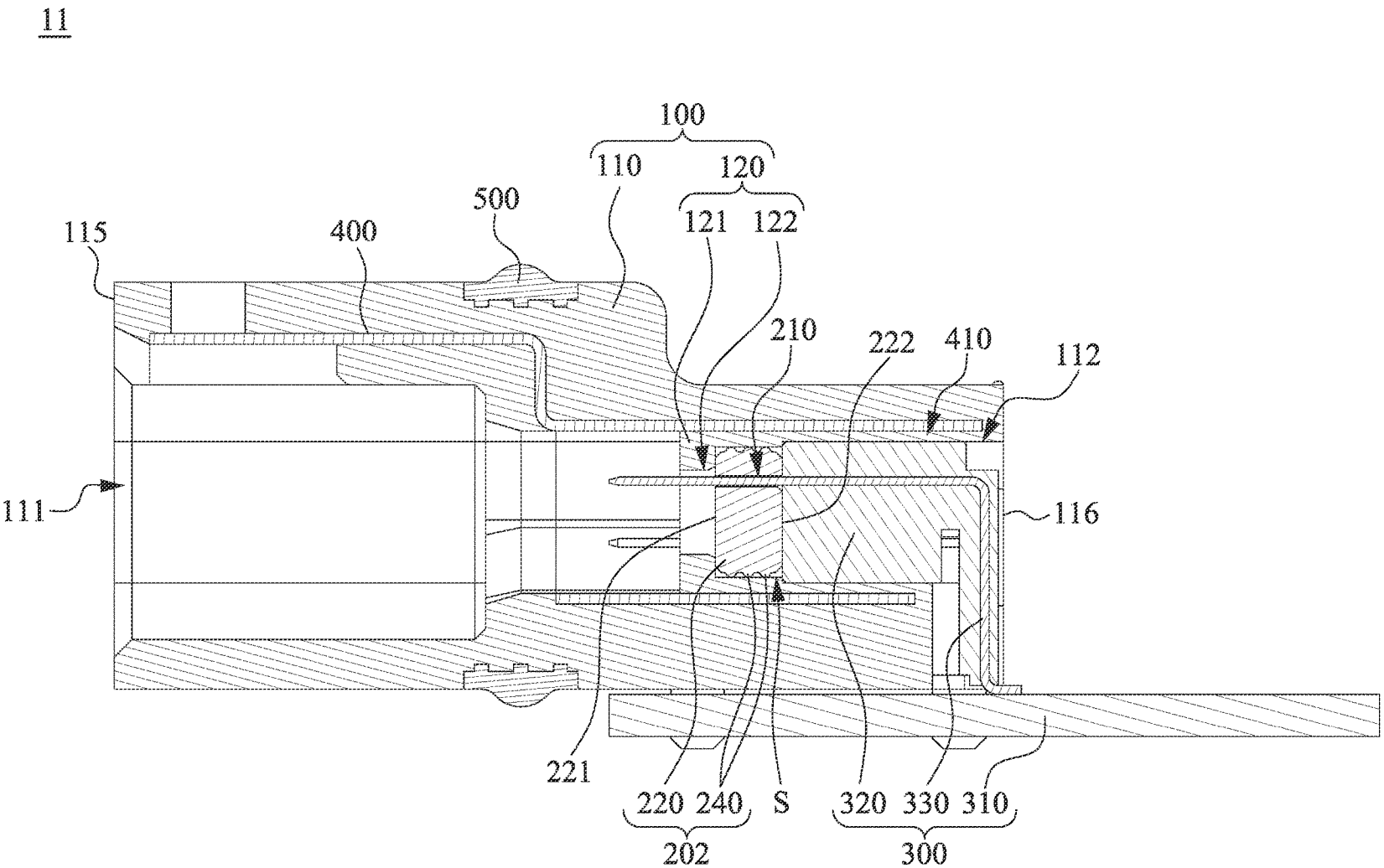
FIG. 6 is a cross-sectional view of the electrical connector according to one embodiment of the disclosure, whose section position being same as the local area M of FIG. 3.

FIG. 6 is a cross-sectional view of the electrical connector 11 according to one embodiment of the disclosure, whose section position being same as the local area M of FIG. 3. As shown in FIG. 6, the electrical connector 11 of the embodiment is substantially the same to the electrical connector of FIG. 3. However, at least one difference of the electrical connector 11 of FIG. 6 from the electrical connector 10 of FIG. 3 is that, the elastic airtight member 202 in FIG. 6 is not provided with the aforementioned outer protrusion 230 for inserting into the single break 122. A part of the elastic airtight member 202 is in contact with the single break 122. More specifically, a portion of the first surface 221 of the elastic body 220 contacts and covers the partition member 120, and another part thereof contacts and covers the single break 122. The conductive terminals 330 respectively extend outwards from the first surface 221 of the elastic body 220, and collectively extend into the first slot 111 from the single break 122.

Figure 7:
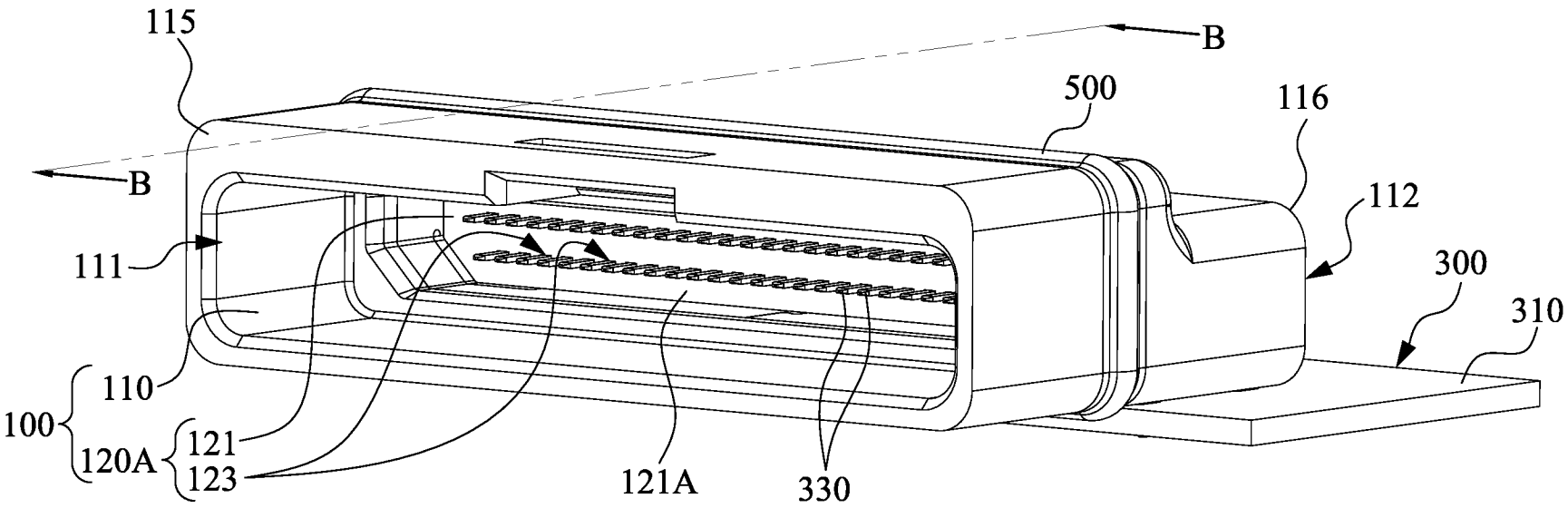
FIG. 7 is a perspective view of an electrical connector according to one embodiment of the disclosure.
Figure 8:
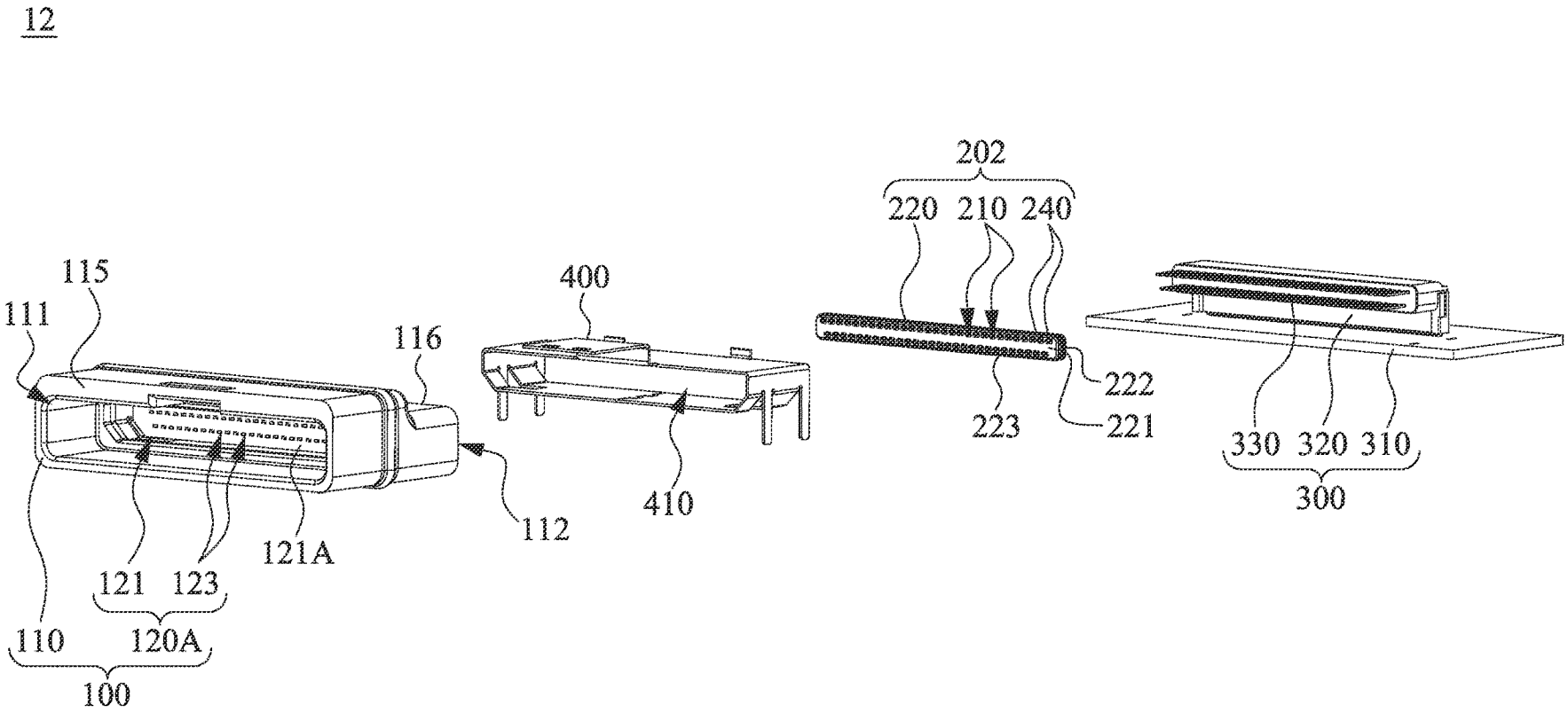
FIG. 8 is an exploded view of the electrical connector of FIG. 7.
Figure 9:
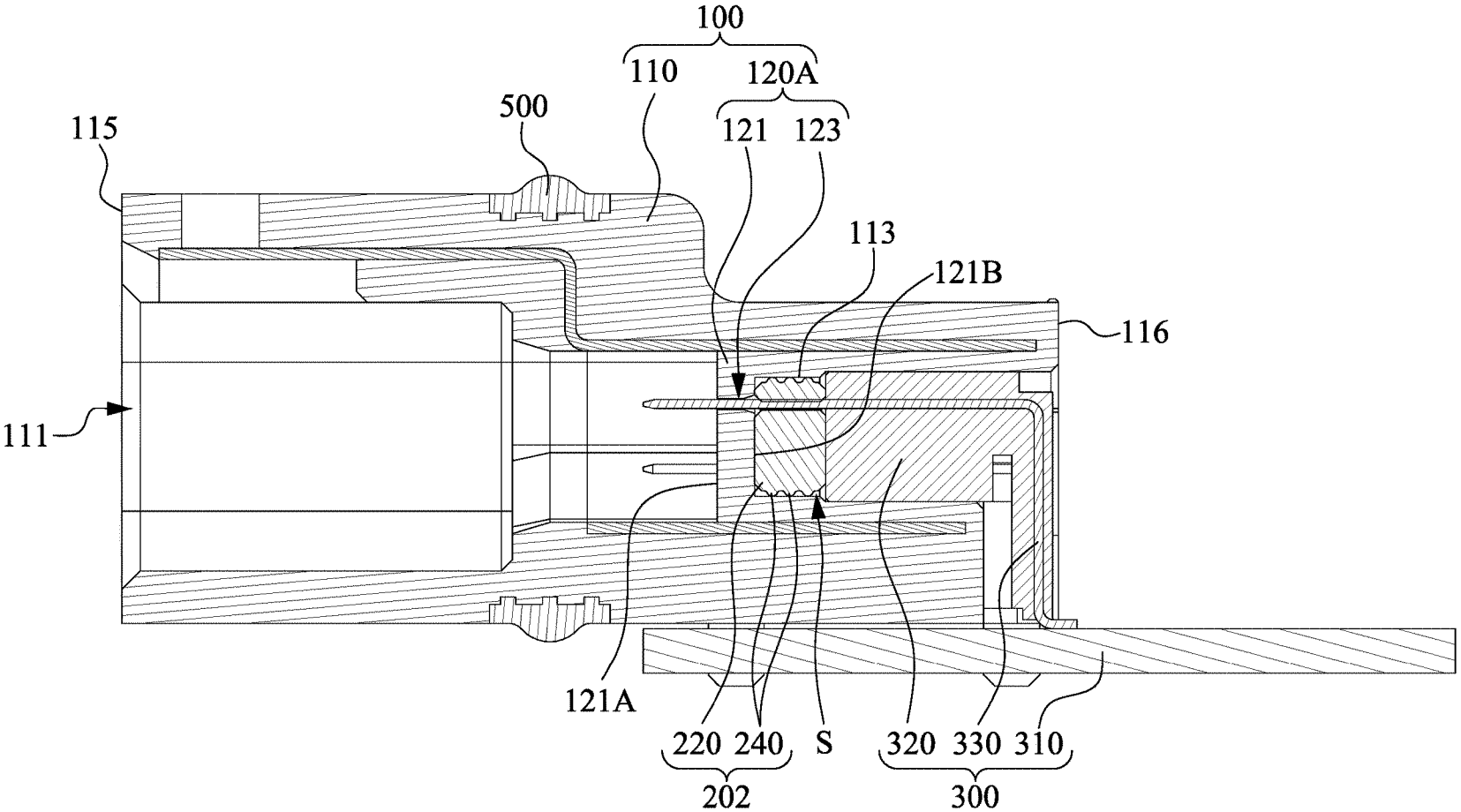
FIG. 9 is a cross-sectional view of the electrical connector of FIG. 7 taken along a line BB.

Reference is now made to FIG. 7 to FIG. 9 in which FIG. 7 is a perspective view of an electrical connector 12 according to one embodiment of the disclosure. FIG. 8 is an exploded view of the electrical connector 12 of FIG. 7. FIG. 9 is a cross-sectional view of the electrical connector 12 of FIG. 7 taken along a line BB. As shown in FIG. 7 to FIG. 9, the electrical connector 12 in FIG. 7 is substantially the same to the electrical connector 10 of FIG. 2. However, at least one difference of the electrical connector 12 of FIG. 7 from the electrical connector 10 of FIG. 2 is that, the partition member 120A is not formed with the aforementioned single break, and the partition member 120A basically shields the elastic airtight member 202 so that the elastic airtight member 202 cannot be exposed outwards from the first slot 111. In addition, the elastic airtight member 202 is only provided with the elastic body 220, and is not provided with the outer protrusion 230 for inserting into the aforementioned single break 122.

In specific, the partitioning plate 121 of the partition member 120A is provided with two opposite surfaces 121A, 121B. One of the opposite surfaces 121A of the partitioning plate 121 faces towards the first slot 111, and the other of the opposite surfaces 121B of the partitioning plate 121 faces towards the second slot 112. The partitioning plate 121 of the partition member 120A is only provided with a plurality of second through holes 123. The second through holes 123 are arranged spaced on the partitioning plate 121. Each of the second through holes 123 can be seen as a penetrating opening which is formed on the partitioning plate 121, and in communication with the first slot 111 and the second slot, that is, each of the second through holes 123 is respectively connected to the opposite surfaces 121A, 121B. Each of the second through holes 123 is passed through by one of the conductive terminals 330. On the other words, the second through holes 123 are distributed on the partitioning plate 121 according to the aforementioned abreast arrangement. The second through holes 123 are respectively aligned with the first through holes 210 of the elastic airtight member 202 one by one, so that the conductive terminals 330 coaxially pass through the second through holes 123 via the first through holes 210 respectively and collectively extend into the first slot 111. Each of the second through holes 123 is not a large-area single break, in other words, for example, the cross-sectional area of a single break is greater than the sum of the aperture sizes of the second through holes 123. However, the disclosure is not limited thereto. In other embodiments, the number of the conductive terminals and the second through holes may be individually only one in number.

Thus, when the connector module 300 is assembled into the second slot 112 from the other end 116 of the main frame 110, the elastic airtight member 202 is pressed by the insulation base 320 and the partition member 120A respectively, so that the elastic airtight member 202 is compressed and deformed between the insulation base 320 and the partition member 120A. In other words, one surface 121B of the partitioning plate 121 facing towards the second slot 112 is hermetically covered by the elastic airtight member 202.

It is noted, in the above embodiments, the elastic airtight member is with flexibility or elasticity, so the aforementioned elastic airtight member can be automatically restored to its original state after being no longer deformed. The elastic airtight member can be made of airtight materials such as rubber, plastic, silicone or other organic materials. Therefore, the elastic airtight member further is airproof, waterproof or dustproof. However, the disclosure is not limited to these kinds.

Therefore, with the structure described in the above embodiments, the disclosure can not only effectively prevent moisture from infiltrating into the rear end of the electrical connector, but also meet the purpose of structural simplification and cost improvement of the electrical connector.

Although the disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. An electrical connector, comprising:

an outer case comprising a main frame and a partition member, the partition member formed within the main frame to define a first slot and a second slot therein, and the first slot is used to receive an outer connector;

an insulation base fixedly connected to the main frame, and disposed within the second slot, wherein the insulation base is formed with at least one accommodating passage;

an elastic airtight member disposed within the second slot, and interposed between the insulation base and the partition member, wherein the elastic airtight member hermetically covers the partition member directly, and the elastic airtight member is formed with at least one first through hole; and at least one conductive terminal disposed within the insulation base, the elastic airtight member and the partition member, and one end of the at least one conductive terminal extending into the first slot from the partition member, and the other end of the at least one conductive terminal extending outwards from the insulation base through the second slot, wherein, one part of the at least one conductive terminal protruding outwards from an outer surface of the insulation base directly goes through the at least one first through hole and the at least one accommodating passage, and is in direct contact with the elastic airtight member.

2. The electrical connector of claim 1, wherein the second slot of the main frame is formed with a plurality of inner side walls, and the inner side walls are collectively adjoined to surround the partition member, wherein the elastic airtight member is in contact with the inner side walls, the partition member and the insulation base, respectively.

3. The electrical connector of claim 2, wherein the elastic airtight member comprises:

an elastic body sandwiched between the insulation base and the partition member; and at least one strip-shaped convex portion protrudingly formed on an outer side surface of the elastic body, and the at least one strip-shaped convex portion surrounding the elastic body to be pressed by the inner side walls of the second slot.

4. The electrical connector of claim 3, wherein the at least one strip-shaped convex portion is plural in number, and a concave portion is formed between any two neighboring ones of the strip-shaped convex portion.

5. The electrical connector of claim 2, wherein the elastic airtight member comprises:

an elastic body sandwiched between the insulation base and the partition member to be pressed by the inner side walls of the second slot; and at least one strip-shaped groove concavely formed on outer surfaces of the elastic body to surround the elastic body.

6. The electrical connector of claim 2, wherein the partition member comprises:

a partitioning plate located within the main frame, and directly connected to the inner side walls of the second slot to separate the first slot and the second slot, and integrally connected to the main frame, wherein one surface of the partitioning plate is covered by the elastic airtight member; and at least one second through hole formed on the partitioning plate to be in communication with the first slot and the second slot, wherein the at least one second through hole is passed through by the at least one conductive terminal.

7. The electrical connector of claim 2, wherein the partition member comprises:

a partitioning plate located within the main frame, and directly connected to the inner side walls of the second slot to separate the first slot and the second slot, and integrally connected to the main frame; and a single break formed on the partitioning plate to be in communication with the first slot and the second slot, wherein the at least one conductive terminal is arranged within the single break, and a part of the elastic airtight member is in contact with the single break.

8. The electrical connector of claim 1, further comprising:

a shielding frame disposed within the outer case to collectively surround the elastic airtight member and the at least one conductive terminal for electrically shielding the at least one conductive terminal.

9. The electrical connector of claim 1, wherein the outer case further comprises an external sealing strip, the external sealing strip is disposed on an outer surface of the outer case and totally surrounds the outer case.

10. The electrical connector of claim 1, wherein a cross-sectional area of the at least one conductive terminal is equal to an aperture size of the at least one first through hole.

11. An electrical connector, comprising:

an outer case comprising a main frame and a partition member, and the partition member is located within the main frame, and provided with at least one penetrating opening; and a connector module, comprising:

a wired board connected to the main frame;

an insulation base disposed on one end of the main frame, wherein a separating space is maintained between the insulation base and the partition member, wherein the insulation base is formed with at least one accommodating passage; and at least one conductive terminal disposed within the insulation base, one end of the at least one conductive terminal extending through the at least one penetrating opening, and the other end of the at least one conductive terminal connected to the wired board; and an elastic airtight member disposed in the separating space to hermetically cover the partition member directly, and formed with at least one first through hole, wherein one part of the at least one conductive terminal protruding outwards from an outer surface of the insulation base directly goes through the at least one first through hole and the at least one accommodating passage, and is in direct contact with the elastic airtight member.

12. The electrical connector of claim 11, wherein the main frame is formed with a plurality of inner side walls, and the inner side walls are collectively adjoined and surround the partition member, wherein the elastic airtight member is in contact with the inner side walls, the partition member and the insulation base, respectively.

13. The electrical connector of claim 12, wherein the elastic airtight member comprises:

an elastic body sandwiched between the insulation base and the partition member; and at least one strip-shaped convex portion protrudingly formed on an outer side surface of the elastic body, and the at least one strip-shaped convex portion surrounding the elastic body to be pressed by the partitioning plate.

14. The electrical connector of claim 13, wherein the at least one strip-shaped convex portion is plural in number, and a concave portion is formed between any two neighboring ones of the strip-shaped convex portion.

15. The electrical connector of claim 12, wherein the elastic airtight member comprises:

an elastic body sandwiched between the insulation base and the partition member to be pressed by the inner side walls of the main frame; and at least one strip-shaped groove concavely formed on outer surfaces of the elastic body to surround the elastic body.

16. The electrical connector of claim 12, wherein the partition member comprises:

a partitioning plate located within the main frame, and integrally connected to the inner side walls of the main frame, wherein one surface of the partitioning plate is covered by the elastic airtight member; and at least one second through hole formed on the partitioning plate, wherein the at least one second through hole is passed through by the at least one conductive terminal.

17. The electrical connector of claim 12, wherein the partition member comprises:

a partitioning plate located within the main frame, and integrally connected to the inner side walls of the main frame; and a single break formed on the partitioning plate, wherein the at least one conductive terminal is arranged within the single break, and a part of the elastic airtight member is in contact with the single break.

18. The electrical connector of claim 11, further comprising:

a shielding frame disposed within the outer case to collectively surround the elastic airtight member and the at least one conductive terminal for electrically shielding the at least one conductive terminal.

19. The electrical connector of claim 11, wherein the outer case further comprises an external sealing strip, the external sealing strip is disposed on an outer surface of the outer case and totally surrounds the outer case.

20. The electrical connector of claim 11, wherein a cross-sectional area of the at least one conductive terminal is equal to an aperture size of the at least one first through hole.

* * * * *